US009889348B2

(12) United States Patent
Motokawa

(10) Patent No.: US 9,889,348 B2
(45) Date of Patent: Feb. 13, 2018

(54) GOLF CLUB HEAD

(71) Applicant: DUNLOP SPORTS CO. LTD., Kobe-shi, Hyogo (JP)

(72) Inventor: Yuki Motokawa, Kobe (JP)

(73) Assignee: DUNLOP SPORTS CO. LTD., Kobe-Shi, Hyogo (JP)

( * ) Notice: Subject to any disclaimer, the term of this patent is extended or adjusted under 35 U.S.C. 154(b) by 0 days.

(21) Appl. No.: 14/438,075

(22) PCT Filed: Nov. 22, 2013

(86) PCT No.: PCT/JP2013/081481

§ 371 (c)(1),
(2) Date: Apr. 23, 2015

(87) PCT Pub. No.: WO2014/087851

PCT Pub. Date: Jun. 12, 2014

(65) Prior Publication Data

US 2015/0273290 A1 Oct. 1, 2015

(30) Foreign Application Priority Data

Dec. 3, 2012 (JP) ..... 2012-264604

(51) Int. Cl.
*A63B 53/04* (2015.01)
*A63B 60/00* (2015.01)
*A63B 60/54* (2015.01)

(52) U.S. Cl.
CPC ..... *A63B 53/0466* (2013.01); *A63B 60/54* (2015.10); *A63B 2053/045* (2013.01);
(Continued)

(58) Field of Classification Search
CPC ..... A63B 2053/045
(Continued)

(56) References Cited

U.S. PATENT DOCUMENTS 8,647,217 B2 * 2/2014 Nishio ..... A63B 53/04 473/342
2003/0032497 A1 * 2/2003 Sano ..... A63B 53/04 473/324

(Continued)

FOREIGN PATENT DOCUMENTS

JP 11-114107 A 4/1999
JP 2006-110008 A 4/2006

(Continued)

OTHER PUBLICATIONS

International Search Report issued in PCT/JP2013/081481, dated Feb. 25, 2014.

*Primary Examiner* — Aarti B Berdichevsky
*Assistant Examiner* — Rayshun Peng
(74) *Attorney, Agent, or Firm* — Birch, Stewart, Kolasch & Birch, LLP

(57) ABSTRACT

Provided is a golf club head which produces an improved hitting sound obtained without impairing the appearance of the sole section. A golf club head having a hollow portion (i) formed therein has a sole portion (5) which forms the bottom surface of the head. The sole portion (5) includes a thin-wall portion (8) and a thick-wall portion (9) which has a greater thickness than the thin-wall portion (8). The golf club head is characterized in that a portion of the inner surface of the thick-wall portion (9), the portion facing the hollow section, has a rib (10) secured to the portion by welding.

8 Claims, 8 Drawing Sheets

(52) U.S. Cl.
CPC ..... *A63B 2053/0408* (2013.01); *A63B 2053/0433* (2013.01); *A63B 2053/0458* (2013.01); *A63B 2060/002* (2015.10)

(58) Field of Classification Search
USPC ..... 473/346, 344
See application file for complete search history.

(56) References Cited

U.S. PATENT DOCUMENTS

| | | | | |
|---|---|---|---|---|
| 2004/0121853 | A1* | 6/2004 | Caldwell | A63B 53/0466 473/345 |
| 2008/0139338 | A1* | 6/2008 | Matsunaga | A63B 53/0466 473/346 |
| 2009/0298613 | A1* | 12/2009 | Hirsch | A63B 53/0466 473/346 |
| 2010/0120556 | A1 | 5/2010 | Yamamoto et al. | |
| 2010/0273574 | A1 | 10/2010 | Yamamoto | |
| 2011/0312440 | A1 | 12/2011 | Wada et al. | |
| 2012/0142450 | A1* | 6/2012 | Wada | A63B 53/0466 473/345 |

FOREIGN PATENT DOCUMENTS

| | | | |
|---|---|---|---|
| JP | 2007-7327 | A | 1/2007 |
| JP | 2010-115334 | A | 5/2010 |
| JP | 2010-252897 | A | 11/2010 |
| JP | 2012-396 | A | 1/2012 |

* cited by examiner

GOLF CLUB HEAD

TECHNICAL FIELD

The present invention relates to a golf club head that may improve hitting sound without deteriorating appearance.

BACKGROUND ART

A golf club head provided a hollow portion therein is known. Since the golf club head of this type is designed within a range of a limited mass, there is a tendency that a thin-wall sole portion would be designed due to increase in head volume. In order to obtain a thin-wall sole portion, a press forming product made of a thin rolled steel strip, for example, may be employed as a sole member. This aspect is advantageous in terms of productivity and cost. On the other hand, there is a problem that a golf club head having a thin-wall sole portion generates low hitting sound that many golfers do not prefer.

In order to improve the hitting sound of the golf club head, it has been proposed to provide a rib on the inner surface, which faces the hollow portion, of the sole portion (See, Patent Document 1).

RELATED ART DOCUMENTS

Patent Documents

Patent Document 1: Japanese Unexamined Patent Application Publication No. 2010-115334

SUMMARY OF INVENTION

Problems to be Solved by the Invention

The rib may be fixed by welding to the inner surface of the sole portion. Heat of the rib at the time of welding affects the metal structure of the sole portion. When the thickness of the sole portion is thin, for example, the thermal energy applied from inside of the sole portion at the time of welding may change the metal structure of the outer surface of the sole portion. In this case, a welding mark such as burnt with a color change may occur on the outer surface of the sole portion. Thus there is a problem that such a welding mark makes the appearance of the head worse.

In order to hide the welding mark on the outer surface of the sole portion, there is necessity that the welding mark is covered with painting. Unfortunately, by painting, the flexibility of the sole design of the club head may be limited and the productivity may be deteriorated.

The present invention has been worked in view of the problem described above, it is an object of the present invention to provide a golf club head having an improved hitting sound without deteriorating appearance. Another object of the present invention is the provision of a golf club head that is not required limited design, in particular that is capable of having a finish treatment without painting, regarding finish treatment of a sole portion

Means for Solving the Problems

The present invention is a golf club head provided a hollow portion therein, including a sole portion forming a bottom surface of the head, the sole portion including a thin-wall portion and a thick-wall portion having a thickness larger than that of the thin-wall portion, and a rib fixed by welding on an inner surface of the thick-wall portion.

In another aspect of the golf club head in accordance with the present invention, the thick-wall portion may include a first thick-wall portion extending in a toe-heel direction, and the rib may extend in the toe-heel direction on the first thick-wall portion.

In another aspect of the golf club head in accordance with the present invention, the thin-wall portion may include a front thin-wall portion arranged forward of the first thick-wall portion and a rear thin-wall portion arranged backward of the first thick-wall portion.

In another aspect of the golf club head in accordance with the present invention, the thick-wall portion may include a second thick-wall portion arranged forward of the front thin-wall portion, and a third thick-wall portion arranged backward of the rear thin-wall portion.

In another aspect of the golf club head in accordance with the present invention, the rib may be intermittently welded on the inner surface of the thick-wall portion in a longitudinal direction of the rib.

In another aspect of the golf club head in accordance with the present invention, the rib may be intermittently welded on the inner surface of the thick-wall portion at positions of its longitudinal both ends and at least one place between the both ends.

In another aspect of the golf club head in accordance with the present invention, the rib may have a height of from 2 to 6 mm and a width of from 0.5 to 1.5 mm.

In another aspect of the golf club head in accordance with the present invention, the difference between thicknesses of the thick-wall portion and the thin-wall portion may be not less than 0.3 mm.

In another aspect of the golf club head in accordance with the present invention, the thick-wall portion may have a thickness of from 0.8 to 1.6 mm.

In another aspect of the golf club head in accordance with the present invention, the sole portion may have a region including a welded position of the rib, and an outer surface of the region may be finished without painting.

In another aspect of the golf club head in accordance with the present invention, the finish treatment may include mirror finish.

Effects of the Invention

The sole portion of the golf club head in accordance with the present invention includes the thin-wall portion and the thick-wall portion having a thickness larger than that of the thin-wall portion. The thin-wall portion is useful for provision of a larger head volume by providing the sole portion with small mass. The rib is fixed by welding to the inner surface of the thick-wall portion. The rib may improve the hitting sound by increasing the rigidity of the sole portion so as to reduce its vibration.

Since the thermal capacity of the thick-wall portion of the sole portion is greater than that of the thin-wall portion, the effects of heat hardly lead to the outer surface of the sole portion when the rib is welded to the inner surface of the thick-wall portion of the sole portion. Accordingly, in the golf club head in accordance with the present invention, a welding mark does not appear on the outer surface of the sole portion at all, or appears in a small size that is unrecognized by naked eyes. Therefore the golf club head in accordance with the present invention may prevent the deterioration of appearance of the sole portion.

The sole portion of the golf club head in accordance with the present invention maintains an excellent appearance without painting. Accordingly, the finish treatment without painting such as mirror finish may be employed. This makes it possible to provide a degree of freedom for designing the sole portion of the golf club head and improve productivity of the golf club head.

MODE FOR CARRYING OUT THE INVENTION

Figure 1:
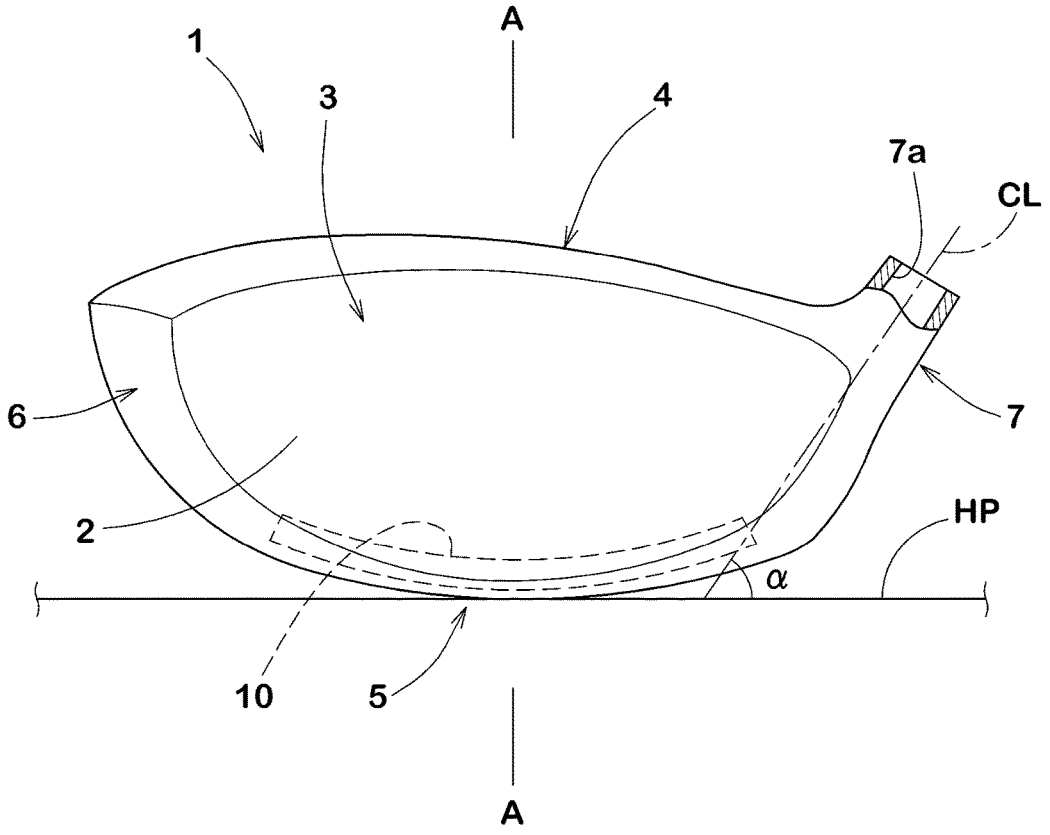
FIG. 1 is a front elevation view of a golf club head in accordance with the present invention.
Figure 2:
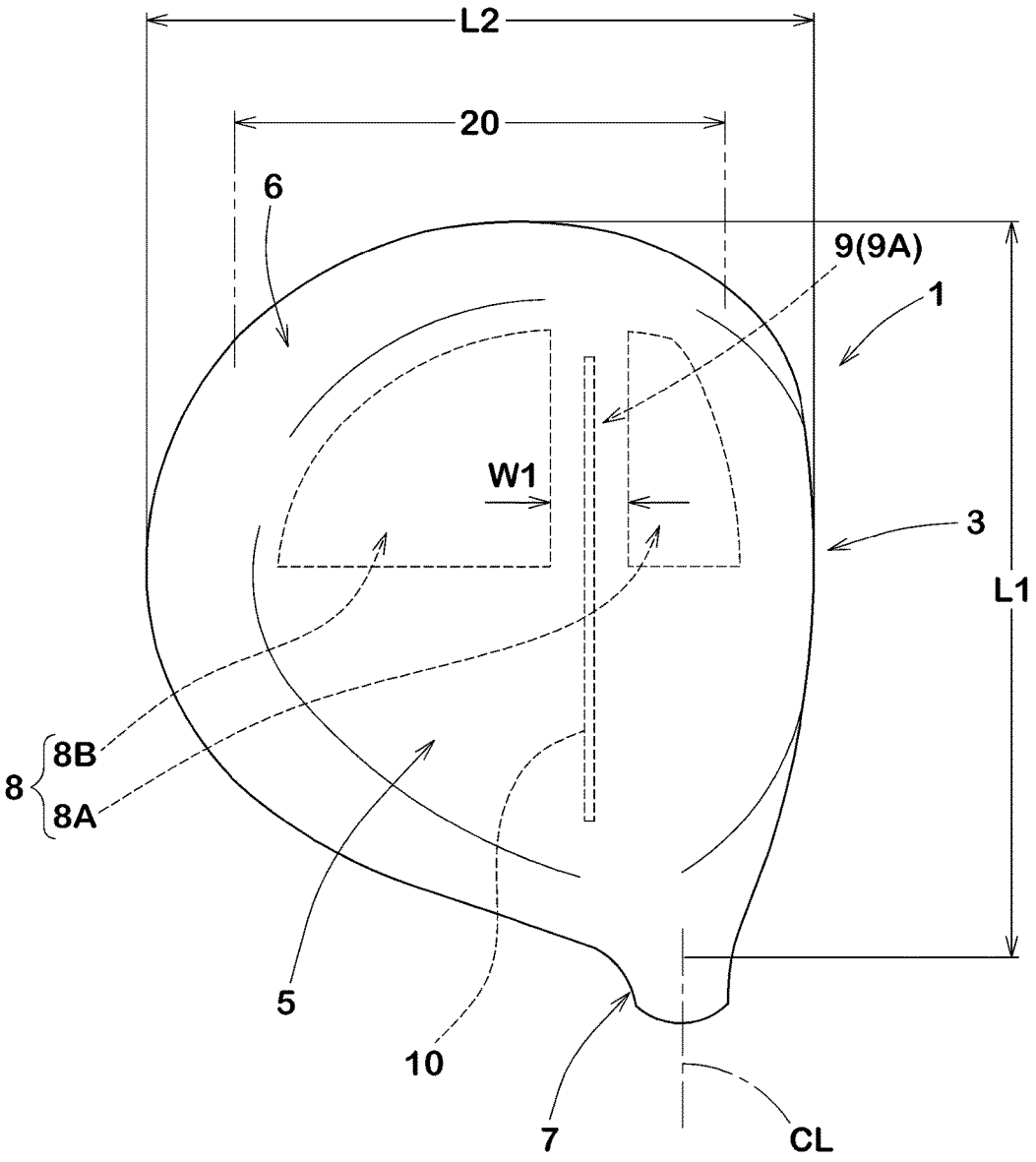
FIG. 2 is a bottom view of FIG. 1.

An embodiment of the present invention will be explained below with reference to the accompanying drawings. FIG. 1 is a front elevation view of a golf club head 1 (hereinafter, it my be referred to as "head") 1 in accordance with the present invention, FIG. 2 is a bottom view of FIG. 1, and FIG. 3 is a cross sectional view taken along lines A-A of FIG. 1.

Referring to FIG. 1, the head 1 is under a standard condition. The standard condition of the head 1 means a condition where the head 1 is placed on a horizontal plane HP with its lie angle $\alpha$ and its loft angle $\beta$ (as shown in FIG. 3. for the loft angle). Through this description, the head 1 is supposed to be kept in the standard condition unless otherwise noted.

Figure 3:
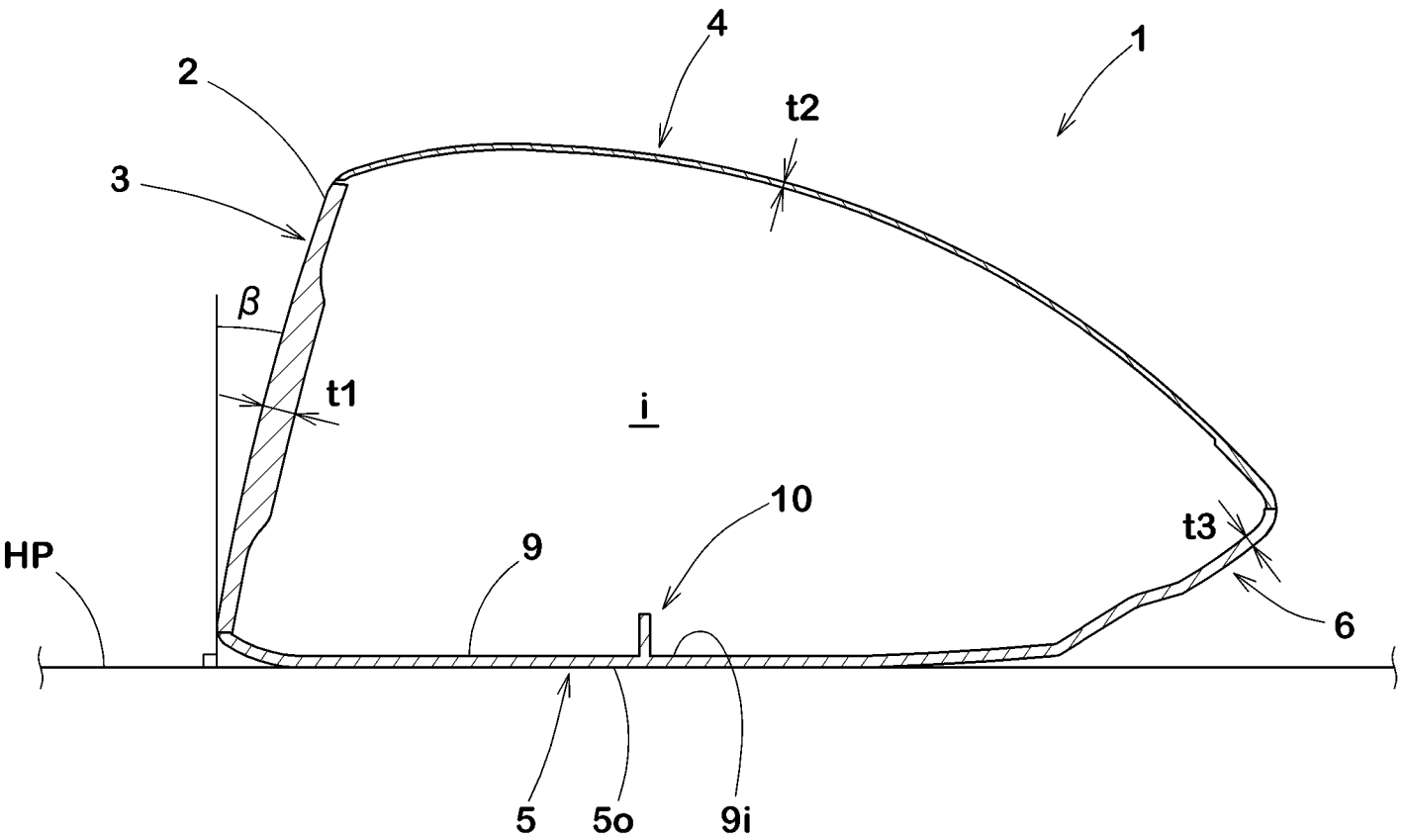
FIG. 3 is a cross sectional view taken along lines A-A of FIG. 1.

As shown in FIG. 3, the head 1 is provided with a hollow portion (i) therein. The major part of the hollow portion (i) is a void filled by a gas. In another aspect, a weight adjustment member, e.g. a gel may be arranged in the hollow portion (i).

The head 1 in accordance with the present embodiment is a wood-type. The wood-type head typically includes both kinds of driver head (#1) and fairway wood head. Furthermore, the concept of the wood-type head further includes a kind of utility-type head having the different club name and numbers from those. The wood-type golf club head generally has a loft angle in a range of from 8 to 30 degrees.

The head 1 has a volume in a range of not less than 90 $cm^3$, more preferably not less than 100 $cm^3$. On the other hand, the head 1 has a volume in a range of not more than 470 $cm^3$, more preferably not more than 460 $cm^3$; in view of the golf rules.

The head 1 has a mass in a range of not less than 170 g, more preferably not less than 180 g, but preferably not more than 260 g, more preferably not more than 250 g for better golf swings.

As shown in FIGS. 1 to 3, the head 1 includes a face portion 3 having a face 2 for hitting a ball, a crown portion 4 forming a top surface of the head, a sole portion 5 forming a bottom surface of the head, a side portion 6 connecting between the crown portion 4 and the sole portion 5, and a hosel portion 7 having a shaft insertion hole 7*a* to which a club shaft (not shown) to be inserted. The centerline CL of the shaft insertion hole 7*a* corresponds to a shaft centerline (not shown) of the club shaft to be attached later.

As used herein, various directions for the head 1 are defined. The front side of the head 1 means the side of the face 2 relatively, and the opposite side is the rear side of the head 1. Furthermore, the toe-heel direction of the head 1 refers to a direction parallel to the centerline CL of the shaft insertion hole 7*a* on the bottom view of the head 1 under the standard condition as shown in FIG. 2. In FIG. 2, the front-back direction refers to a direction perpendicular to the toe-heel direction.

The major part of the head 1, for example, is made of metallic material. Namely, the face portion 3, the crown portion 4, the sole portion 5 and the hosel portion 7 are made of metallic material. For example, the metallic material for forming the head 1 may be employed stainless steel, a maraging alloy, a titanium alloy or the like.

Figure 4:
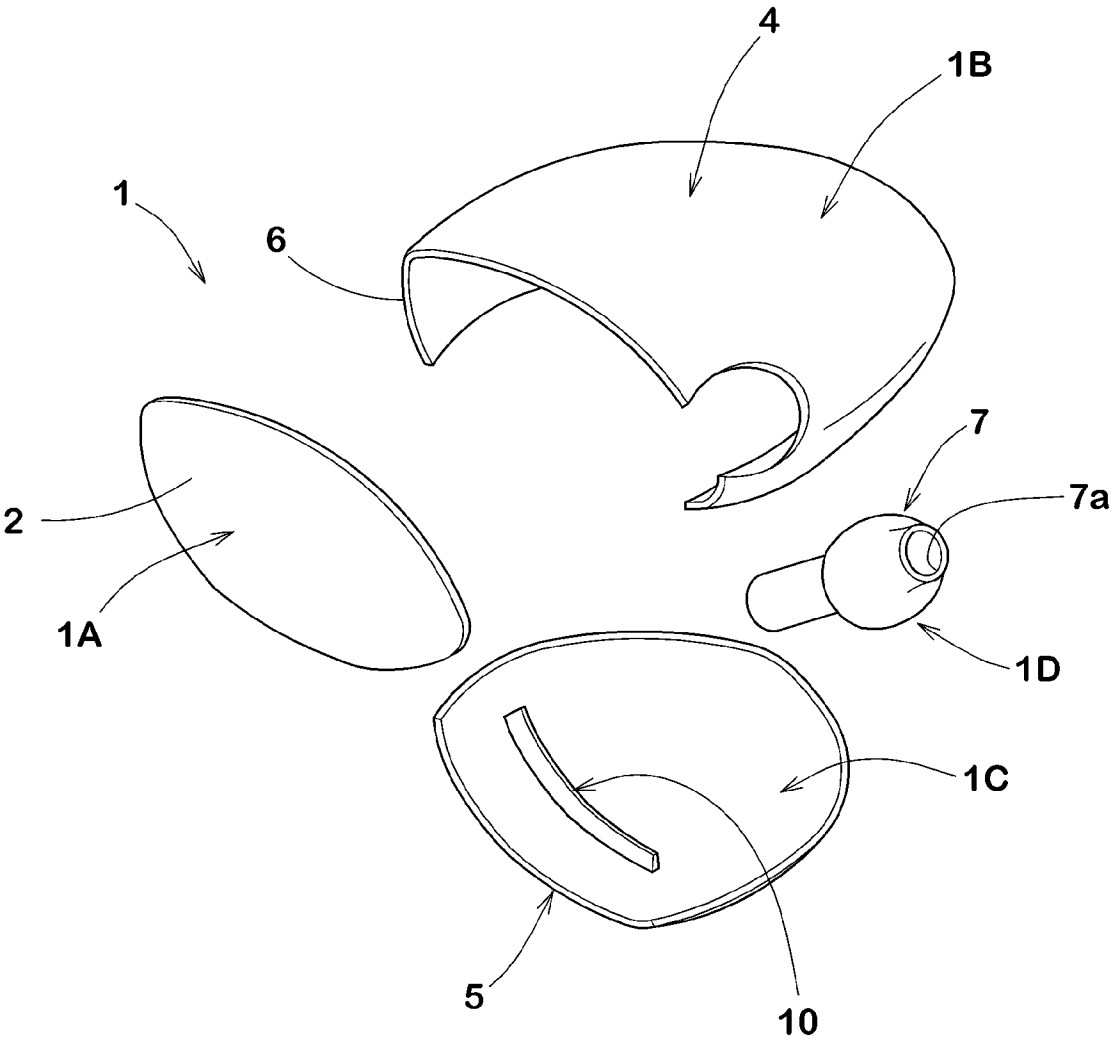
FIG. 4 is an exploded view of the head.

As shown in FIG. 4, the head 1, for example, has a four-piece structure in which a face member 1A, a head main body member 1B, a sole member 1C and a neck member 1D are joined. However, the head 1 may be configured as a two-piece structure or a three-piece structure.

The face member 1A includes the face 2. The face member 1A, for example, is formed of a plate shape. For the face member 1A, a cup-like shape including a flange (not shown) extending rearwardly from the periphery of the face 2 may preferably be used.

The head main body member 1B includes the crown portion 4 and the side portion 6. The face member 1A is fixed to the front side of the head main body member 1B. The head main body member 1B has a recess for attaching the neck member 1D on its heel side.

The sole member 1C includes the sole portion 5, and is formed of a plate shape. In this embodiment, the sole member 1C is a press formed product in which rolled steel or the like is plastically deformed by press forming. For example, the sole member 1C is fixed to lower edges of the respective face member 1A and the head main body member 1B by welding.

The neck member 1D includes the hosel portion 7, and is formed using NC machining. The neck member 1D is fixed to the recess of the head main body member 1B.

In order to optimize the location of the center of gravity of the head and the repulsion performance, the respective members 1A to 1D may be made of metallic materials having different specific gravities. In this embodiment, each of the members 1A to 1D is made of a titanium alloy. Preferably, the whole head 1 may be made of a metallic material. Alternatively, a fiber reinforced resin may be used as a part of the head 1.

In order to resist impact of hitting a golf ball, the face portion 3 is required to have sufficient strength. As shown in FIG. 3, the maximum thickness t1 of the face portion 3 is preferably in a range of from 3.3 to 4.0 mm.

In order to resist impact of hitting a golf ball, the crown portion 4 is also required to have sufficient strength. On the other hand, the thickness of the crown portion 4 is large, the head 1 tends to have high center of gravity. In view of the above, the thickness t2 of the crown portion 4 is preferably in a range of approximately 0.5 to 0.9 mm.

The side portion 6 preferably has a thickness t3 in a range of from 0.7 to 1.2 mm in order to maintain the lightweight of the head and high moment of inertia around the vertical axis passing through the center of gravity of the head in well balance.

Figure 5:
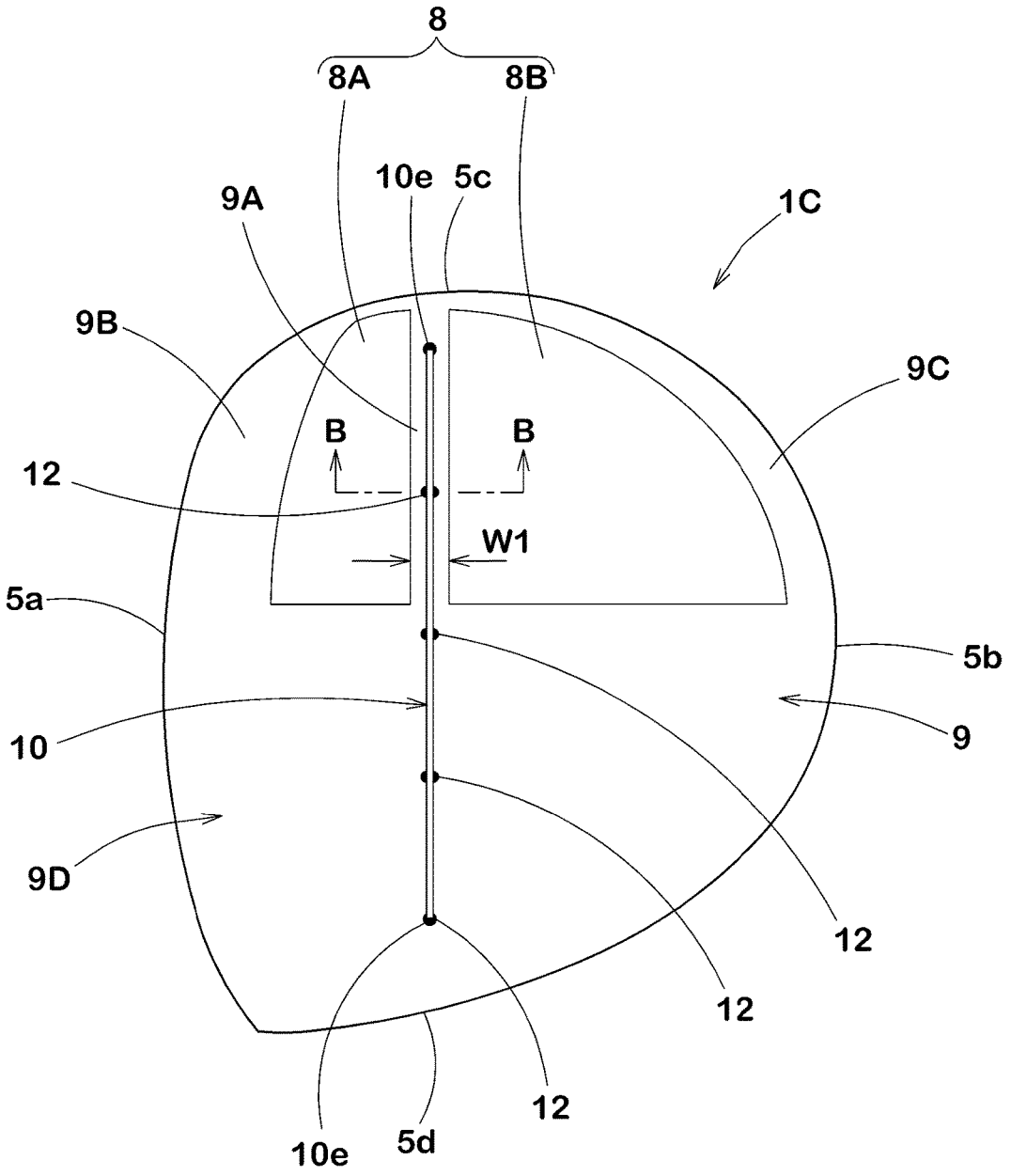
FIG. 5 is a plan view of a sole member viewed from its inner surface.
Figure 6:
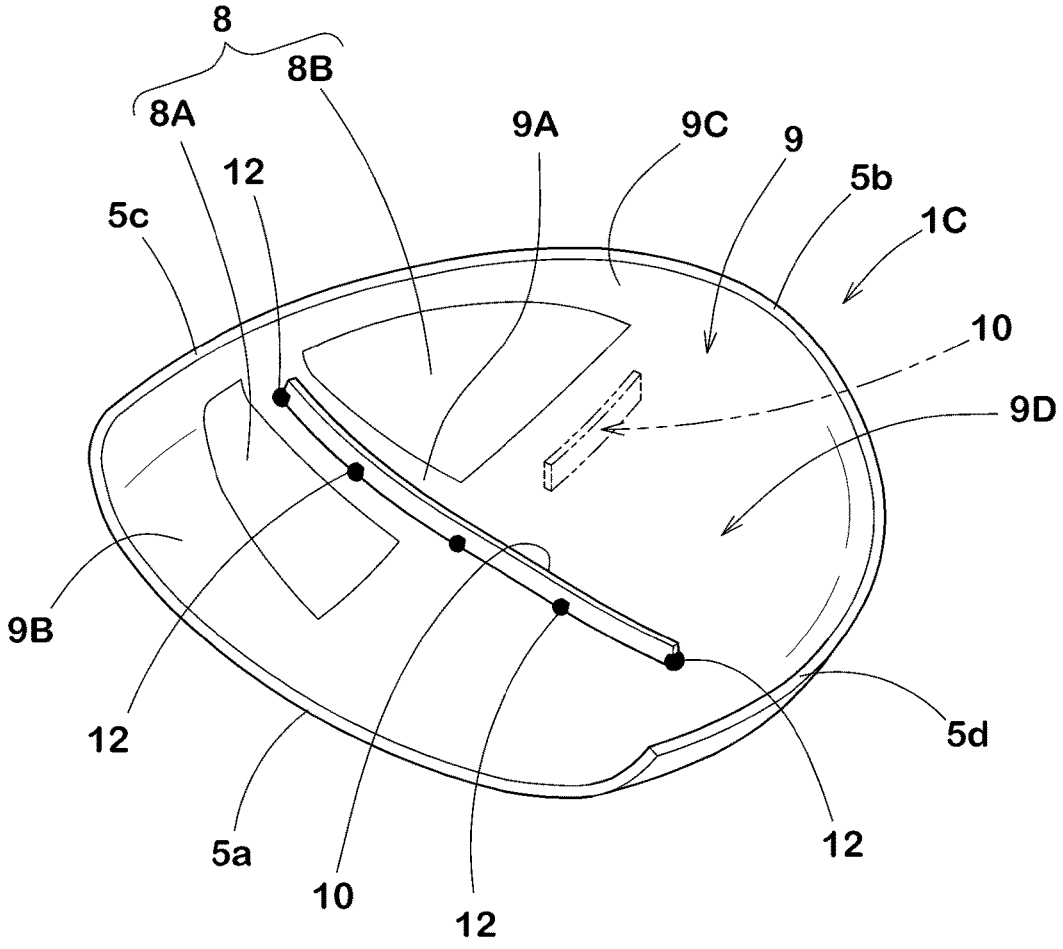
FIG. 6 is a perspective view of the sole member.

FIG. 5 illustrates a plan view of the sole member 1C viewed from the hollow portion. FIG. 6 illustrates a perspective view of the sole member 1C. The sole member 1C has an approximately circular outline shape surrounded by a front edge 5*a* located in the front side (the face side) of the head, a rear edge 5*b* located in the back side of the head, a toe-side edge 5*c* located in the toe side of the head and a heel-side edge 5*d* located in the heel side of the head. The outline shape of the sole member 1C is not particularly limited to the illustrated embodiment.

The sole portion 5 includes a thin-wall portion 8 and a thick-wall portion 9 having a thickness larger than that of the thin-wall portion 8. The reduced mass from the sole portion 5 by providing the thin-wall portion 8 may be redistributed to the thick-wall portion 9. Thus the weight may be flexibly and arbitrarily distributed into the sole portion 5 based on locations of the thin-wall portion 8 and the thick-wall portion 9. Accordingly, the location of the center of gravity of the head and the amount of the moment of inertia may be designed.

Furthermore, the thick-wall portion 9 has bending rigidity larger than that of the thin-wall portion 8. Thus rigidity of the sole portion 5 may be changed due to the location of the thick-wall portion 9.

Thus, the center of gravity of the head, moment of inertia and rigidity distribution of the sole portion 5 may be flexibly designed by modifying the locations of the thin-wall portion 8 and the thick-wall portion 9. These specific examples will be described later.

Figure 7:
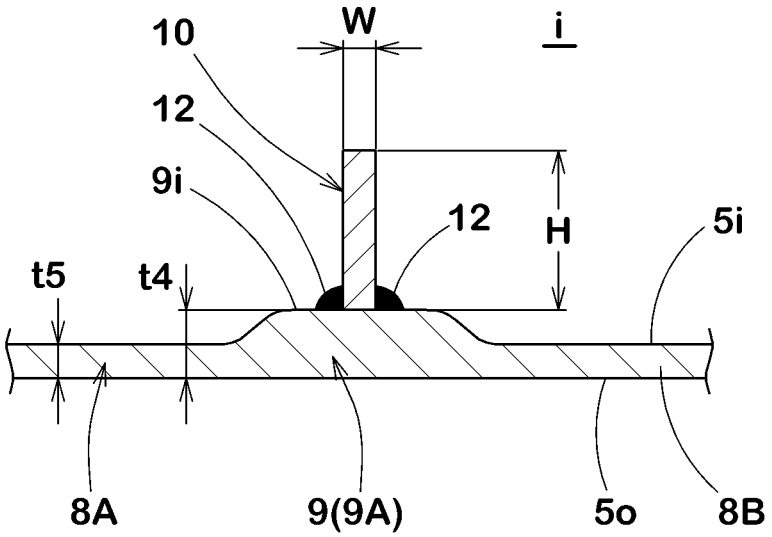
FIG. 7 is a cross sectional view taken along lines B-B of FIG. 5.

In the present invention, as shown in FIG. 5 and FIG. 7 which is a cross sectional view taken along lines B-B of FIG. 5, a rib 10 is fixed by welding to an inner surface 9*i*, which faces the hollow portion (i), of the thick-wall portion 9. In this embodiment, as shown in FIG. 5, one rib 10 extends along the sole portion 5. Such a rib 10 may increase the bending rigidity of the sole portion 5 and reduce vibration of the sole portion 5 when hitting a ball. Thus, the hitting sound produced by the head 1 may be improved as a higher frequency sound to which many golfers prefer.

Furthermore, since the thermal capacity of the thick-wall portion 9 of the sole portion 5 is greater than that of the thin-wall portion 8, the effects of heat hardly lead to the outer surface 5*o* of the sole portion 5 when the rib 10 is welded to the inner surface 5*i* of the sole portion 5. Accordingly, in the golf club head 1 in accordance with the present invention, a welding mark does not appear at all on the outer surface 5*o* of the sole portion 5, or appears in a very small size that is unrecognized by naked eyes. Thus the outer surface 5*o* of the sole portion 5 may exhibit an excellent appearance. The outer surface 5*o* of the sole portion 5 may be finished as mirror treatment by buffing the sole member 1C without painting, for example. The head 1 in accordance with the present invention may offer a high degree of freedom for designing the outer surface 5*o* of the sole portion 5 while eliminating requirement of painting and improve productivity.

The cross sectional shape of the rib 10, which is not particularly limited, may include a semicircular shape, a triangular shape and the like. As shown in FIG. 7, the rib 19 in accordance with the present embodiment has a rectangular cross sectional shape. In order to improve the effects of vibration reduction, the cross sectional shape of the rib 10 is preferably a longitudinal long shape having the height H larger than the width W. In order to improve the hitting sound quality as a comfortable high-pitched sound without additional weight, the height H of the rib 10 is preferably in a range of from 2 to 6 mm. Similarly, the width W of the rib 10 is preferably in a range of from 0.5 to 1.5 mm.

The whole length of the rib 10 measured along the rib, which is not particularly limited, is preferably in a range of from 3% to 75% of the maximum toe-heel length L1 of the head 1, as shown in FIG. 2, in order to improve the hitting sound quality as a comfortable high-pitched sound without additional weight. The maximum toe-heel length L of the head 1 is a distance in the toe-heel direction between the outermost toe edge and the outermost heel edge under the state where the head 1 is placed on a horizontal plane with a lie angle of 60 degrees based on the provision of the distance in toe-heel direction defined by the golf rule of R&A. When the position of the outermost heel edge is not clear, it should be obtained using the measurement described in the section 194 of the golf rule.

The number of rib 10 provided on the sole portion 5, which is not particularly limited, is preferably in a range of from approximately 1 to 3.

As shown in FIGS. 5 and 6, the thick-wall portion 9 in accordance with the present embodiment, for example, includes a first thick-wall portion 9A extending along the toe-heel direction, and the rib 10 also extends along the toe-heel direction on the first thick-wall portion 9A. The combination of the first thick-wall portion 9A and the rib 10 may further improve bending rigidity of the sole portion 5, and in particular improve bending rigidity around the front-back direction of the head, thereby producing the hitting sound quality as a high-pitched sound. In this aspect, since the first thick-wall portion 9A may serve the similar function of the rib 10, the rib 10 with a small height H may be employed. The rib 10 is not particularly limited to one that extends along the toe-heel direction, and may extend in the front-back direction. Here, the phrase "along the toe-heel direction" includes not only the aspect that the rib 10 and the first thick-wall portion 9A extend parallel to the toe-heel direction, but also the aspect that the rib 10 and the first thick-wall portion 9A extend in an angle of less than 45 degrees with respect to the toe-heel direction.

As shown in FIG. 2, at least a part of the first thick-wall portion 9A and the rib 10 is preferably arranged in a central region 20 of the head 1 in the front-back direction. The central region 20 is a region located in the center of the head in the front-back direction and having a length of 75% of the maximum front-back length L2 of the head 1. The central region 20 tends to vibrate easily after hitting a golf ball. By providing the rib 10 and the thick-wall portion 9 in the central region 20, a large effect for improving the hitting sound may be obtained. Furthermore, the width (see the reference symbol W1 for the first thick-wall portion 9A) of the thick-wall portion 9 is greater than the width W of the rib 10. In order to maintain sufficient thermal capacity while distributing weight around the sole portion 5, the width of the thick-wall portion 9 is preferably in a range of from 3 to 20 mm.

The thin-wall portion 8, for example, includes a front thin-wall portion 8A arranged forward of the first thick-wall portion 9A and a rear thin-wall portion 8B arranged backward of the first thick-wall portion 9A. In the preferred embodiment, the thick-wall portion 9 further includes a second thick-wall portion 9B arranged forward of the front thin-wall portion 8A and a third thick-wall portion 9C arranged backward of the rear thin-wall portion 8B. Furthermore, the whole area of the heel side of the sole portion 5 in accordance with the present embodiment is formed of a fourth thick-wall portion 9D. Such a sole portion 5 may have high moment of inertia around a vertical axis because sufficient weight is distributed in the periphery of the sole portion 5. Furthermore, since the peripheral portion of the sole member 1C has a large thickness, the sole portion 5 may have high durability so as to prevent heat injury thereon when welding to the other member.

Figure 8:
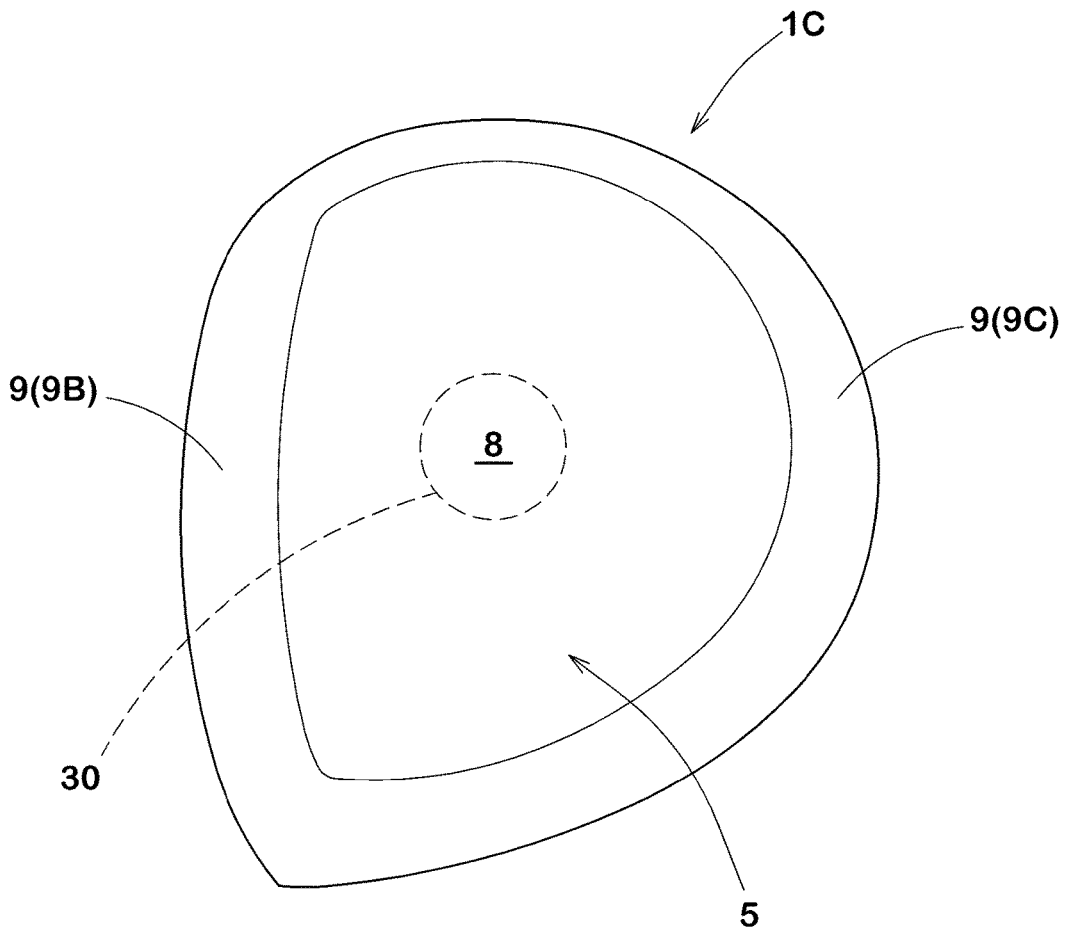
FIG. 8 is a plan view of a sole member in accordance with another aspect.

FIG. 8 illustrates the sole portion 5 in accordance with another embodiment of the invention. In this embodiment, the central area of the sole portion 5 is formed of the thin-wall portion 8. The second thick-wall portion 9B and the third thick-wall portion 9C are provided in the front and rear sides of the thin-wall portion 8, respectively. After hitting a ball, the antinode of vibration, which has the maximum amplitude, of such a sole portion 5 may appear in the middle portion 30 of the thin-wall portion 8. In the embodiment shown in FIG. 8, the first thick-wall portion 9A and the rib 10 may reduce the vibration of the sole portion 5 so that the hitting sound is further improved into a high-pitched sound.

As shown in FIGS. 5 and 6, the rib 10 is intermittently welded on the inner surface of 9*i* the thick-wall portion 9 in a longitudinal direction of the rib 10. In this embodiment, the rib 10 is provided with welded beads 12 intermittently at positions of its longitudinal both ends 10*e* and 10*e*, and at least one place between the both ends. As shown in FIG. 7, welding, for example, is fillet welding that is done at the corner between the rib 10 and the inner surface 9*i* of the thick-wall portion 9, and that is added a triangle cross sectional molten material bridging between them. Each of the welded beads 12 is formed into a spotted shape on both sides of the rib 10 in the width direction thereof without extending in a long shape along the rib. Preferably, the maximum outer diameter of the spotted welded bead 12 is in a range of from 2 to 5 mm.

In the embodiment as described above, the thermal energy applied to the sole portion 5 when welding is suppressed to be very low. Thus the thermal effect on the outer surface 5*o* of the sole portion 5 is also suppressed to be minimum, thereby effectively preventing the generation of the welding mark thereon. The specific process of welding is not particularly limited, but arc welding with small output, particularly TIG welding and the like is preferable.

As shown in FIG. 7, in the sole portion 5, the thick-wall portion 9 and the thin-wall portion 8 have the respective constant thicknesses. The junction between the thick-wall portion 9 and the thin-wall portion 8 has a thickness that gradually varies.

In order to prevent increase of mass while maintaining sufficient thermal capacity, the thickness t4 of the thick-wall portion 9 is preferably not less than 0.8 mm, more preferably not less than 0.9 mm, still further preferably not less than 1.0 mm, but preferably not more than 1.6 mm, more preferably not more than 1.4 mm, still further preferably not more than 1.2 mm.

In order to ensure durability of the sole portion while maintaining mass margin, the thickness t5 of the thin-wall portion 8 is preferably not less than 0.5 mm, more preferably not less than 0.6 mm, still further preferably not less than 0.7 mm, but preferably not more than 1.0 mm, more preferably not more than 0.9 mm, still further preferably not more than 0.8 mm.

The difference t4−t5 between the thickness t4 of the thick-wall portion 9 and the thickness t5 of the thin-wall portion 8 is preferably not less than 0.2 mm, more preferably not less than 0.3 mm. On the other hand, the thickness difference t4−t5 is excessively large, stress tends to concentrate the boundary between them and to lower the durability of the sole portion 5. Thus the thickness difference t4−t5 is preferably set not more than 0.8 mm.

The sole member 1C which includes the thick-wall portion 9 and the thin-wall portion 8, for example, is formed from a first molding product having a constant thickness. In this embodiment, the thin-wall portion 8 is shaped by dissolving a part of the first molding product through an etching process. The thick-wall portion 9 is formed of the non-etching part having the original thickness of the first molding product by being masked during the etching process. With this, the sole member 1C is obtained in high productivity.

In the head 1 in accordance with the present embodiment, the welding mark does not substantially appear on the outer surface 5*o* of the sole portion 5. Thus the sole portion 5 has a region including a welded position of the rib 10, wherein the outer surface of the region is finished without painting.

The finish treatment includes mirror finish, for example. The mirror finish is to polish a target area to obtain a smooth surface as a mirror by a buff or barrel type polishing means. For the degree of mirror finish, it is preferable that the outer surface 5*o* of the sole portion 5 is polished up to be able to reflect a skin color of a person.

Furthermore, in another aspect of the finish treatment, a hairline finish, a satin finish, or a satin-mirror finish may be employed. The hairline finish is a finish that has an outer surface with very narrow lines on it each of which appears as a hair, and a matte surface condition as compared to the mirror finish. Satin finish may provide a luster surface with matte appearance which is milder than the mirror finish by processing with abrasive paper coarser than buff, rubbing with a wire brush or using a combination of chemicals. Satin-mirror finish is an approximately intermediate finish between satin and mirror finishes with respect to a mirror condition. With respect to the finish treatment without painting to the outer surface 5*o* of the sole portion 5, it is not particularly limited to these.

While the particularly preferable embodiments in accordance with the present invention have been described in detail, the present invention is not limited to the specific embodiments, but can be modified and carried out in various aspects.

EXAMPLES

Wood type golf club heads having a basic structure shown in FIGS. 1 to 7 and specifications of Table 1 were prototyped and then each of the heads was tested with respect to the existence of a welding mark on the sole portion, natural frequency, and mass. Each rib was fixed to the sole portion using TIG welding. Major specifications of the tested golf club heads are as follows:

Head volume: 440 $cm^3$
Material of face member: 6-4 Ti
Material of head main body member: 3-1-1-1 Ti
Material of sole member: BT341 Ti
Material of neck member: 3-2 Ti
Maximum toe-heel length of head L1: 120 mm
Maximum front-back length of head L2: 110 mm
Width of rib W: 0.8 mm
Length of rib: 90 mm
First thick-wall portion width W1: 6.8 mm
Welding Condition
  Gas: Argon gas
  Gas current: 5 to 10 (l/min.)
  Welding current: 80 plus/minus 10 (A)
  Welding speed: zero (spot welding)

Number of welding portions: five (one means a set of welded bead portions on both sides of rib in its width direction)

Maximum outer diameter of welding portions: 2 to 6 mm

Existence of Welding Mark

The existence of a welding mark on the outer surface of the sole portion of the respective heads was checked by naked eyes.

Natural Frequency

As for the hitting sound, a primary natural frequency of the head was measured. The primary natural frequency was measured in the head alone. The measurement method is as follow:

(a) Attach an acceleration pickup on the sole portion of the head.

(b) Fix a thread to the end of the hosel portion of the head.

(c) Hang the head through the thread.

(d) Impact on the outer surface of the sole portion of the head by an impact hammer with a force pickup.

(e) Acquire data of impact exciting force F through the force pickup of the impact hammer.

(f) Acquire response acceleration "A" through the acceleration pickup.

(g) Acquire the primary natural frequency from the primary minimal value of dynamic mass that is obtained by the relation as follows:

Dynamic mass=impact exciting force *F*/response acceleration "*A*".

DESCRIPTION OF THE REFERENCE NUMERAL

1 Golf club head
2 Face
3 Face portion
4 Crown portion
5 Sole portion
8 Thin-wall portion
8A Front thin-wall portion
8B Rear thin-wall portion
9 Thick-wall portion
9*i* Inner surface of thick-wall portion
9A First thick-wall portion
9B Second thick-wall portion
9C Third thick-wall portion
10 Rib
i Hollow portion

The invention claimed is:

1. A golf club head provided with a hollow portion therein, comprising:

a sole portion forming a bottom surface of the head, the sole portion comprising a thin-wall portion having a thickness in a range of from 0.5 to 0.8 mm and a thick-wall portion having a thickness larger than the thickness of the thin-wall portion wherein the thickness of the thick-wall portion is in a range of from 0.8 to 1.6 mm, the thick-wall portion comprising a first thick-wall portion extending in a toe-heel direction so that a toe side end of the first thick-wall portion reaches a toe-side end of the sole portion,

TABLE 1

| | Ref. 1 | Ref. 2 | Ref. 3 | Ref. 4 | Ref. 5 | Ref. 6 | Ex. 1 | Ex. 2 | Ex. 3 |
|---|---|---|---|---|---|---|---|---|---|
| Existence of rib | Absence | Absence | Absence | Presence | Presence | Presence | Presence | Presence | Presence |
| Thickness t5 of thin-wall portion of sole portion (mm) | 0.7 | 1.0 | 1.5 | 0.7 | 1.0 | 1.5 | 0.7 | 0.7 | 0.7 |
| Thickness t4 of thick-wall portion of sole portion (thickness of sole portion at rib welded portion) (mm) | 0.7 | 1.0 | 1.5 | 0.7 | 1.0 | 1.5 | 0.9 | 1.0 | 1.5 |
| Difference t4 − t5 (mm) | 0 | 0 | 0 | 0 | 0 | 0 | 0.2 | 0.3 | 0.8 |
| Existence of welding mark on outer surface of sole portion (Naked eyes check) | — | — | — | Clearly visible | None | None | Visible through loupe | None | None |
| Primary natural frequency of head (Hz) | 2700 | 2850 | 3000 | 3300 | 3500 | 3500 | 3400 | 3500 | 3600 |
| Rib Height H (mm) | 0 | 0 | 0 | 4.8 | 4.8 | 4.8 | 4.8 | 4.8 | 4.8 |
| H + t4 (mm) | 0.7 | 1 | 1.5 | 5.5 | 5.8 | 6.3 | 5.7 | 5.8 | 6.3 |
| Increase or decrease of head mass (g) | −2.5 | 0.1 | 4.3 | −1.0 | 1.5 | 5.7 | −0.3 | 0 | 1.7 |

| | Ex. 4 | Ex. 5 | Ex. 6 | Ex. 7 | Ex. 8 | Ex. 9 | Ex. 10 | Ex. 11 |
|---|---|---|---|---|---|---|---|---|
| Existence of rib | Presence | Presence | Presence | Presence | Presence | Presence | Presence | Presence |
| Thickness t5 of thin-wall portion of sole portion (mm) | 0.7 | 0.7 | 0.7 | 0.7 | 0.7 | 0.8 | 0.9 | 1.0 |
| Thickness t4 of thick-wall portion of sole portion (thickness of sole portion at rib welded portion) (mm) | 0.8 | 1.6 | 2.0 | 1.0 | 1.0 | 1.0 | 1.0 | 1.0 |
| Difference t4 − t5 (mm) | 0.1 | 0.9 | 1.3 | 0.3 | 0.3 | 0.2 | 0.1 | 0 |
| Existence of welding mark on outer surface of sole portion (Naked eyes check) | Visible through loupe | None | None | None | None | None | None | None |
| Primary natural frequency of head (Hz) | 3350 | 3600 | 3650 | 3100 | 3650 | 3500 | 3500 | 3500 |
| Rib Height H (mm) | 4.8 | 4.8 | 4.8 | 2.0 | 6.0 | 4.8 | 4.8 | 4.8 |
| H + t4 (mm) | 5.6 | 6.4 | 6.8 | 3 | 7 | 5.8 | 5.8 | 5.8 |
| Increase or decrease of head mass (g) | −0.7 | 2.1 | 3.4 | −1.4 | −0.1 | 0.1 | 0.5 | 1.0 |

From the test results, it was confirmed that the example golf club heads had improved the hitting sound without deteriorating appearance.

the thin-wall portion comprising a front thin-wall portion arranged forward of the first thick-wall portion and a rear thin-wall portion arranged backward of the first thick-wall portion, wherein the front thin-wall portion has a width in a front-back direction of the golf-club head smaller than that of the rear thin-wall portion, the thick-wall portion further comprising a second thick-wall portion arranged forward of the front thin-wall portion and a third thick-wall portion arranged backward of the rear thin-wall portion, wherein the second thick-wall portion and the third thick-wall portion extend along a periphery of the sole portion so as to reach the toe side end of the first thick-wall portion thus making the front and rear thin-wall portions appear substantially as a semi-circle divided by the first thick-wall portion, a rib fixed by welding on an inner surface of the first thick-wall portion, wherein the rib extends in the toe-heel direction on the first thick-wall portion, and wherein a welding mark is not formed by the welding of the rib on the outer surface of the sole portion.

2. The golf club head according to claim 1, wherein the rib is intermittently welded on the inner surface of the thick-wall portion in a longitudinal direction of the rib.

3. The golf club head according to claim 1, wherein the rib is intermittently welded on the inner surface of the thick-wall portion at positions of its longitudinal both ends and at least one place between the both ends.

4. The golf club head according to claim 1, wherein the rib has a height of from 2 to 6 mm and a width of from 0.5 to 1.5 mm.

5. The golf club head according to claim 1, wherein the difference between thicknesses of the thick-wall portion and the thin-wall portion is not less than 0.3 mm.

6. The golf club head according to claim 1, wherein the front thin-wall portion comprises a heel side edge extending straightly in a front-back direction of the golf club head in a plain view of the sole portion.

7. The golf club head according to claim 6, wherein the rear thin-wall portion comprises a heel side edge extending straightly in a front-back direction of the golf club head in a plain view of the sole portion.

8. The golf club head according to claim 7, wherein the heel side edge of the front thin-wall portion and the heel side edge of the rear thin-wall portion are aligned in a line in a plain view of the sole portion.

* * * * *